United States Patent [19]

Bernier

[11] Patent Number: 4,478,449

[45] Date of Patent: Oct. 23, 1984

[54] FIREPLACE TONGS

[76] Inventor: Claude Bernier, 1203, boul. Mont-Royal, Outremont, Quebec, Canada, H2V 2H7

[21] Appl. No.: 460,285

[22] Filed: Jan. 24, 1983

[51] Int. Cl.[3] ..... A47J 49/14

[52] U.S. Cl. ..... 294/10; 294/11; 294/16; 294/106

[58] Field of Search ..... 294/3, 9–11, 294/14, 16, 19 R, 28, 50.8, 50.9, 104, 106, 118, 119

[56] References Cited

U.S. PATENT DOCUMENTS

| | | | |
|---|---|---|---|
| 123,349 | 2/1872 | Lander et al. | 294/10 X |
| 160,006 | 2/1875 | Conklin | 294/10 |
| 384,281 | 6/1888 | Randleman et al. | 294/50.8 |
| 578,832 | 3/1897 | Pope | 294/104 |
| 3,118,697 | 1/1964 | Watters | 294/11 |
| 4,176,871 | 12/1979 | Stover | 294/16 X |

*Primary Examiner*—Johnny D. Cherry
*Attorney, Agent, or Firm*—Robic, Robic & Associates

[57] ABSTRACT

Fireplace tongs comprising a pair of levers connected to one another between their respective ends by means of a first pivot in the manner of scissors, this first pivot defining on one side thereof operating arms and on the other side thereof extensions of the operating arms. One of the extensions constitutes a first jaw for the tongs while a second jaw, similar to the first jaw, is pivotally mounted at one of its ends to the end of the other extension away from the first pivot. A connecting link is provided of which the ends are pivotally mounted on the jaws respectively on one side and on the other side of the first and of the second pivot and adjacent thereto, whereby closing in of the arms causes tightening of the jaws and, alternatively, spreading apart of the operating arms causes loosening of the jaws.

2 Claims, 3 Drawing Figures

FIG. 1
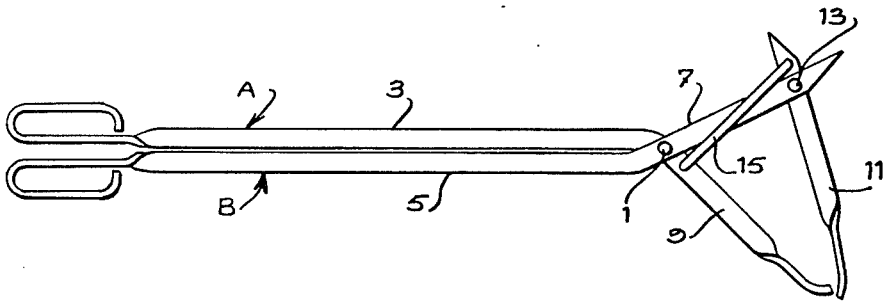
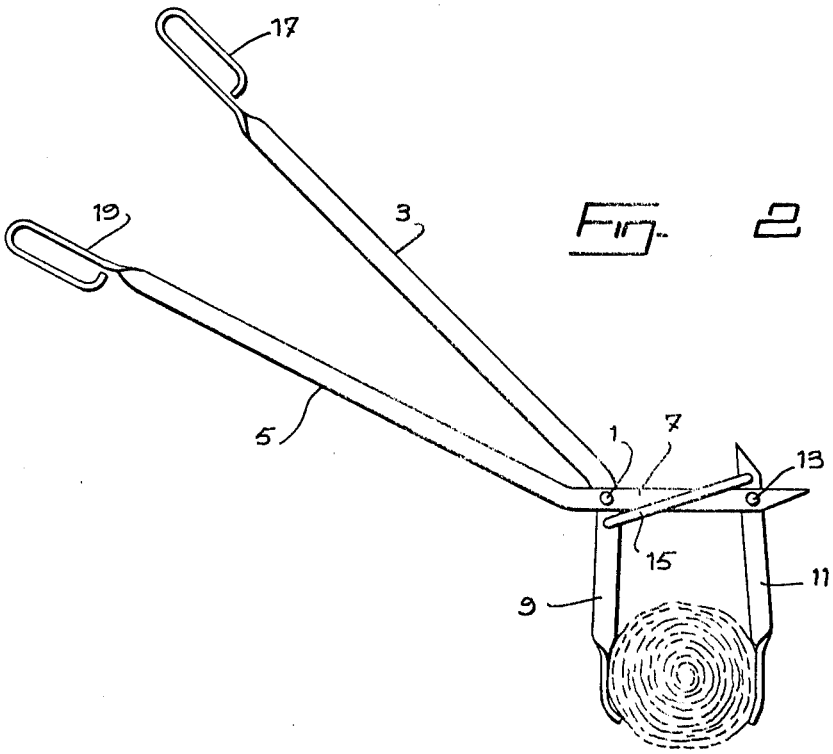
FIG. 2
FIG. 3
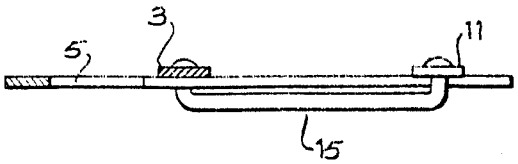

FIREPLACE TONGS

My invention relates to fireplace tongs, or the like, mainly for domestic use.

There are obviously numerous tongs of this type which are used for carrying or arranging logs in relation to domestic fireplaces. I have however observed that the known tongs do not easily lend themselves to the handling of large fire logs mainly due to the fact that the levers of these tongs are straight so that the portion of the levers which act as operating arms, which are longer than the parts that act as tongs, must be appreciably spread out or open in order to grip a fire log of an unusual size. There follows that an important force has to be applied to carry or rearrange such logs. I have also noted that it is relatively difficult to grip large logs when they lie flat, on the ground. These disadvantages and others are apparent in the tong devices which are the objects of the following U.S. patents that were revealed in a preliminary search which I have ordered prior to preparing the present application:

U.S. Pat. No. 123,349—(1872)—Lander
U.S. Pat. No. 125,480—(1872)—Newman
U.S. Pat. No. 163,243—(1875)—Perry
U.S. Pat. No. 463,563—(1891)—Williamson
U.S. Pat. No. 2,089,661—(1937)—Owen
U.S. Pat. No. 3,124,383—(1964)—Cahan
U.S. Pat. No. 4,105,238—(1978)—Stright The object of my invention is the provision of fireplace tongs of the aforedescribed type designed to allow handling of large fire logs with greater ease and less force than that required with known fireplace tongs.

What I wish to claim as my invention, in its broadest expression, are fireplace tongs, for particular use in handling fire logs, comprising: a pair of levers connected together intermediate their respective ends by means of a first pivot in the manner of scrissors, this first pivot defining on one side thereof operating arms and on the other side thereof extensions of the operating arms, one of the extensions constituting a first jaw for the tongs; a second jaw similar to the first jaw; a second pivot mounting one end of the second jaw at the end of the other extension away from the first pivot, and a connecting link of which the ends are pivotally mounted on the jaws, respectively on one side and on the other side of said other extension and adjacent to said pivots, whereby closing in of the operating arms causes tightening of the jaws and spreading apart of the operating arms causes loosening of the jaws.

In order to obtain a still better efficiency, the extensions could be bent relative to their respective operating arm outwardly in a direction away from one another.

The fireplace tongs of my invention could also be made to serve as poker by sharpening the end of the extension which carries the second jaw as well as sharpening the end of the jaw, which jaw end is adjacent to the second pivot.

According to a further embodiment of the invention, the levers and the second jaw are elongated and flat metal members, at least in the areas of the first and second pivots, and the free ends of the jaws are curved toward one another for an adequate gripping of fire logs.

A better understanding of my invention will be had from reading of the description that follows of a preferred embodiment, description having reference to the appended drawing wherein:

FIG. 1 is a plan view of fireplace tongs made according to the teaching of my invention and shown in a completely closed position;

FIG. 2 is a view similar to that of FIG. 1 where the fireplace tongs are illustrated in open position, a fire log being gripped between the jaws, and FIG. 3 is a partial plan view intended more particularly to illustrate the link connecting the jaws.

The illustrated tongs comprise a pair of levers A and B connected to one another between their respective ends by means of a first pivot 1 and in the manner of scissors. This pivot 1 may obviously take the simple form of a pin which is riveted at the ends while permitting oscillation of the levers A and B.

For the purpose of the present description, this pivot 1 will be said to define operating arms 3, 5 on one side and extensions 7, 9 of these operating arms, on the other side.

The extension 9 acts as a first jaw of the tongs.

A second jaw 11, similar to jaw 9, is mounted at one of its ends by means of a second pivot 13, of the same nature as pivot 1, on the end of the extension 7 of the operating arm 5.

A link 15 connects, as shown, the jaws 9 and 11.

As more specifically illustrated in FIG. 3, this link 15 is a round bar of which the ends are curved and extend across the jaw 9 and the jaw 11, respectively, on one side and on the other side of the pivots 1, 13 and adjacent thereto. This link 15 is connected to the jaws 9 and 11 in any known manner but obviously in such a way as to allow pivotal action of the jaws.

It will easily be understood from the above description that when the operating arms 3 and 5 are pivoted, at 1, by spreading them apart, the jaws 9 and 11 will likewise move away from one another through the link 15. The reverse will of course be true when the operating arms 3 and 5 are operated in reverse, that is toward one another.

It will be noted that the extensions 7, 9 are preferably bent relative to their operating arms 3, 5 by moving away from one another thereby providing a larger opening of the jaws 9 and 11. Furthermore, the ends of the jaws 9, 11 are curved inwardly toward one another for an adequate gripping of fire logs.

In the illustrated embodiment, the end of the extension 7 as well as the end of the jaw 11 are sharpened or pointed so that when the fire tongs are closed, they may serve as a poker. Similarly, the levers A and B and the second jaws are made from elongated flat iron members at least in the areas of the pivots 1 and 13. On the other hand, the levers A and B as well as the jaw 11 may be twisted for esthetic purposes except near the pivots 1 and 13.

It goes without saying that handles 17 and 19 will have to be provided at the ends of the operating arms 3 and 5 for the handling of the tongs.

Obviously also, various modifications may be made to the aforedescribed tongs while remaining within the scope of the invention, which scope is defined in the appended claims.

The embodiments of the invention in which an exclusive property or privilege is claimed are defined as follows:

1. Fireplace tongs for particular use in handling fire logs, comprising:

a pair of levers connected together intermediate their respective ends by means of a first pivot in the manner of scissors, this first pivot defining on one side thereof operating arms and on the other side thereof extensions of said operating arms, one of said extensions constituting a first jaw for said tongs;

a second jaw similar to said first jaw;

a second pivot mounting one end of said second jaw at the end of the other of said extensions away from said first pivot; and a connecting link of which the ends are pivotally mounted on said jaws, respectively on one side and on the other side of said other extension and adjacent to said pivots;

wherein said extensions are bent relative to their respective operating arm outwardly in a direction away from one another, wherein the end of said other extension and the end of said second jaw adjacent to said second pivot are pointed; said pointed ends being intended to serve as a poker when said tongs are completely closed; and whereby closing in of said operating arms causes tightening of said jaws and spreading apart of said operating arms causes loosening of said jaws.

2. Fireplace tongs according to claim 1, wherein said levers and said second jaw are elongated and flat metal members, at least in the areas of said first and second pivots, and the free ends of said jaws are curved toward one another for an adequate gripping of fire logs.

* * * * *